US005951206A

United States Patent [19]

Gregory

[11] Patent Number: 5,951,206

[45] Date of Patent: Sep. 14, 1999

[54] FOUNDATION LIFTING AND SUPPORT SYSTEM AND METHOD

[75] Inventor: Steven D. Gregory, Garland, Tex.

[73] Assignee: Gregory Enterprises, Garland, Tex.

[21] Appl. No.: 09/097,902

[22] Filed: Jun. 16, 1998

[51] Int. Cl.[6] ..... E02D 5/00; E02D 7/02

[52] U.S. Cl. ..... 405/230; 405/229

[58] Field of Search ..... 405/230, 229, 405/196–200; 254/29 R

[56] References Cited

U.S. PATENT DOCUMENTS

| | | | |
|---|---|---|---|
| 4,673,315 | 6/1987 | Shaw et al. . | |
| 4,765,777 | 8/1988 | Gregory | 405/230 |
| 4,911,580 | 3/1990 | Gregory et al. . | |
| 4,925,345 | 5/1990 | McCown et al. | 405/230 X |
| 5,006,015 | 4/1991 | Stephens et al. | 405/230 |
| 5,246,311 | 9/1993 | West et al. | 405/230 |
| 5,722,798 | 3/1998 | Gregory . | |

*Primary Examiner*—Dennis L. Taylor
*Attorney, Agent, or Firm*—Haynes and Boone, L.L.P.

[57] ABSTRACT

A foundation lifting and support system and method according to which two mounting units are attached underneath the foundation and to a wall of the foundation, respectively. A piling is inserted thougb support sleeves of the mounting units and, and a load is applied by a hydraulic unit to the pilings to drive the pilings to bedrock. After resistance is encountered, an additional load is applied to raise the foundation and the foundation is secured in the raised position. The additional load can be applied by the same unit that applied the driving load or by a different unit.

32 Claims, 4 Drawing Sheets

FOUNDATION LIFTING AND SUPPORT SYSTEM AND METHOD

BACKGROUND OF THE INVENTION

This invention relates to a system and method for lifting and supporting a building, and, more particularly, to such a system and method in which the foundation or concrete slab of a building is lifted and supported in its raised position by a plurality of pilings.

Houses and other buildings are often erected on foundations, or concrete slabs, which are not in direct contact with load supporting underground strata, such as bedrock, or the like. If not initially constructed properly, or if soil conditions change, the foundation footing may settle, causing the foundation or slab to sag and/or crack. Unless the building is supported, or shored, continued settling may result in major structural damage or collapse of the building.

There have been several suggestions in the prior art for raising and supporting the foundation or slab of a building of this type. For example, according to one technique, beam members, or the like, are placed underneath the foundation and lifted to raise the foundation. However, this requires significant excavation of the ground area around the foundation which is very time consuming and labor intensive. Also, according to some of the latter techniques, the foundation or slab is lifted, or jacked up, and pilings are inserted underneath to support same. However, the pilings are often not directly supported on the bedrock, resulting in continued settling after the pilings are in place. Further, in many instances, the pilings are visible above the basement floor.

In still other prior art techniques utilizing pilings, a single hydraulically actuated system is used to drive each piling, requiring the use of a relatively high hydraulic pressure system which is expensive and cumbersome to use. Also, in these systems it is difficult to apply a symmetrical load along the axes of the pilings which is essential to avoid undue stresses and strains on the pilings.

Therefore, what is needed is a foundation lift and support system in which the pilings are supported on bedrock, and a symmetrical, stabilized, coaxially-directed load is applied to the pilings requiring minimal excavation and relatively low hydraulic lifting pressure.

SUMMARY OF THE INVENTION

The present invention, therefore, provides a system for supporting and raising a foundation in which two mounting units are attached underneath the foundation and to a wall of the foundation, respectively. A piling is inserted though support sleeves of the mounting units and, and a load is applied by a hydraulic unit to the pilings to drive the pilings to bedrock. After resistance is encountered, an additional load is applied to raise the foundation and the foundation is secured in the raised position.

As a result of the system and method of the present invention the foundation is raised and supported in an efficient manner with a minimum of time and effort.

DESCRIPTION OF THE PREFERRED EMBODIMENT

Figure 1:
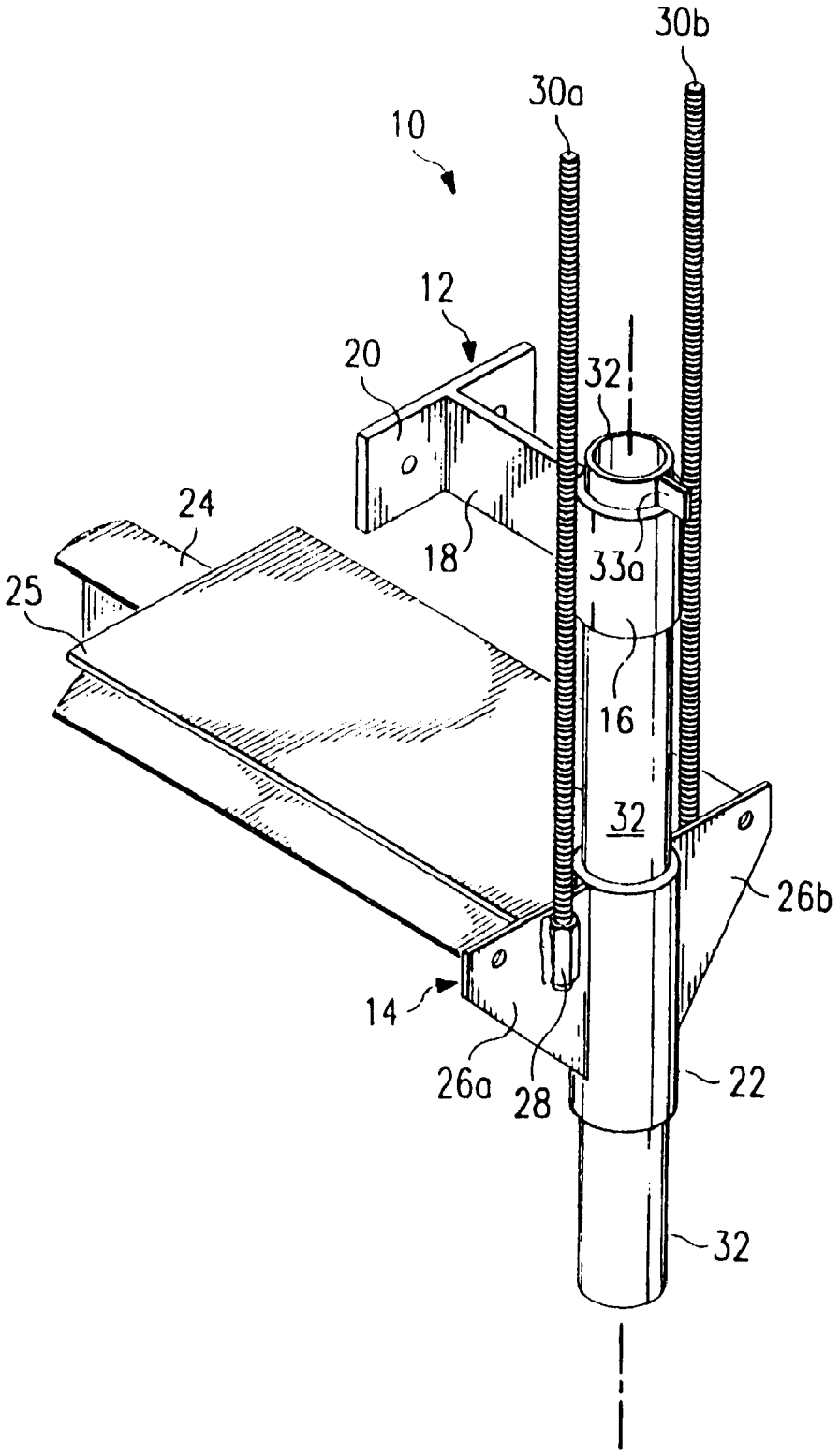
FIGS. 1 and 2 are perspective views of the system of the present invention respectively depicting two stages of the driving operation for the pilings.

Referring specifically to FIG. 1 of the drawings, the reference numeral 10 refers, in general, to a portion of the system of the present invention which includes an upper mounting assembly 12 and a lower mounting assembly 14. The upper mounting assembly 12 includes a support sleeve 16 having a plate, or arm, 18 extending perpendicular thereto. A mounting plate 20 is attached to the distal end of the plate 18 and extends perpendicular to the latter plate. The mounting plate 20 is adapted to be secured to the side wall of a foundation by bolts, or the like, extending through openings provided in the plate, as will be described. It is understood that the plate 20 can engage the foundation wall in a parallel relation thereto or it can extend at an angle thereto in which case shims or the like (not shown) could be inserted between the plate and the wall. The plate 18 is connected to the support sleeve 16 and to the plate 20 in any conventional manner, such as by welding.

The lower mounting assembly 14 includes a support sleeve 22, an I-beam 24 connected to the support sleeve, and an angle plate 25 attached to the upper surface of the I-beam. The I-beam 24 and the angle plate 25 extend underneath the foundation to be lifted, as will be explained, with the angle plate providing increased strength and surface area. Also, a pair of attachment plates 26*a* and 26*b* are connected to diametrically opposed outer surfaces of the support sleeve 22 and extend perpendicular to the I-beam 24. Each of the plates 26*a* and 26*b* has an opening extending therethrough for connection to a hydraulic ram unit and to a hydraulic lifting unit that will be described. The I-beam 24 and the plates 26*a* and 26*b* are connected to the sleeve 22, and the angle plate 25 is connected to the I-beam, in any conventional manner, such as by welding.

A elongated nut 28 is welded to the plate 26*a* and another nut (not shown), identical to the nut 28, is welded to the back side of the plate 26*b*, as viewed in FIG. 1. A pair of threaded rods 30*a* and 30*b* are threadedly engaged with the nuts, including the nut 28, and extend upwardly from the plate for reasons to be described.

The support sleeves 16 and 22 are disposed in a spaced, coaxial relationship and each extends over a guide sleeve 32 having its upper end portion extending upwardly from the upper end of the support sleeve 16 as viewed in FIG. 1, and its lower end extending downwardly from the support sleeve 22. A lip 32*a* is attached to the upper end portion of the guide sleeve 32 and engages the upper end of the support sleeve 16 to locate the sleeve 32 axially relative to the support sleeve 16.

Figure 2:
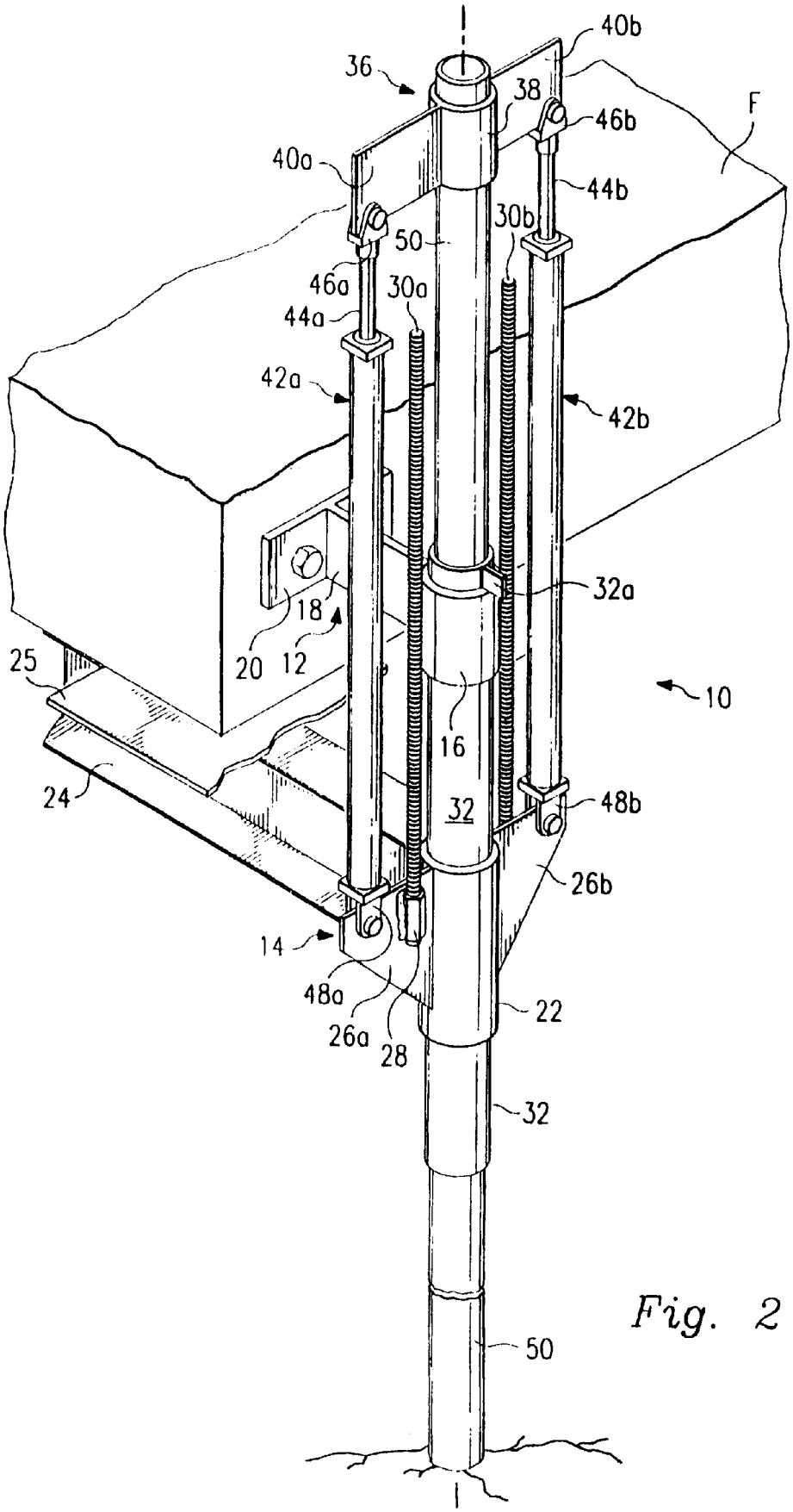

The system 10 is shown mounted to a side wall of a foundation F in FIG. 2 and also includes a clamping assembly 36 which extends above the upper mounting assembly 12 and includes a gripping sleeve 38 coaxially aligned with the guide sleeve 32. It is understood that the sleeve 38 is in the form of a conventional "slip bowl" for grabbing or clamping over a pipe, or piling, to drive the piling in one direction. To this end, the sleeve 38 includes a plurality of inner arcuate inserts (not shown) which are tapered in a vertical direction so that they will grab, or clamp, a piling of a predetermined diameter and drive same downwardly, as viewed in FIG. 2, and slide over the segment during upward movement, in a conventional manner. A pair of plates 40*a* and 40*b* are connected to, and extend from, diametrically opposite portions of the sleeve 38 and each has an opening extending there through. This clamping assembly 36 is disclosed in more detail in applicant's U.S. Pat. No. 4,765,777, the disclosure of which is hereby incorporated by reference.

The system 10 also includes a pair of drive units, in the form of hydraulic ram units 42*a* and 42*b*, which are installed between the plate 40*a* of the clamping assembly 36 and the plate 26*a* of the lower mounting assembly 14; and between the plate 40*b* of the clamping assembly 36 and the plate 26*b* of the lower mounting assembly 12, respectively. The ram units 42*a* and 42*b* include a pair of arms 44*a* and 44*b*, respectively, which are connected to pistons (not shown) which reciprocate in the ram units in response to actuation of the units, in a conventional manner. This reciprocal movement of the pistons causes corresponding movement of the arms 44*a* and 44*b* between the extended position shown in FIG. 2 and a retracted position to be described.

The ram units 42*a* and 42*b* also include a pair of clevises 46*a* and 46*b*, respectively, which are connected to the respective ends of the arms 44*a* and 44*b*. The clevises 46*a* and 46*b* extend over the plates 40*a* and 40*b*, respectively and are connected to the latter plates by a pair of bolts that extend through aligned openings in the clevises and in the plates. In a similar manner, a pair of clevises 48*a* and 48*b* are connected to the lower ends of the ram units 42*a* and 42*b*, respectively, extend over the plates 26*a* and 26*b*, respectively, and are connected to the latter plates by a pair of bolts that extend through aligned openings in the clevises and the plates.

A piling 50 extends through the sleeve 38 and the guide sleeve 32. The sleeve 38 is sized so as to permit the above-mentioned driving and sliding movement of the sleeve relative to the piling 50. More specifically, due to the tapered configuration of the above-described arcuate inserts, the sleeve 38 can be manually lifted upwardly on the piling 50 without encountering substantial resistance. However, when the hydraulic ram units 42*a* and 42*b* are then retracted, the clamping assembly 36 moves downwardly over the piling 50 and the inserts of the sleeve 38 grab, or clamp, the outer surface of the piling and drive it downwardly, as will be described in further detail later.

To install the system 10, the area around the foundation F to be lifted is initially excavated, the system 10 is placed in the excavated area with the I-beam 24 and the angle plate 25 of the lower mounting assembly 14 extending underneath the foundation with the angle plate in engagement with the lower surface of the foundation. The plate 20 of the upper mounting assembly 12 is bolted to the corresponding side wall of the foundation F in a spaced relation to the lower mounting assembly 14. Although only one system 10 will be described it is understood that, in actual practice, several additional systems can be spaced around the foundation which are identical to, and operate simultaneously with, the system 10.

The guide sleeve 32 is then inserted through the support sleeves 16 and 22 with the lip 32*a* engaging the upper end of the support sleeve 16. The piling 50 is then placed in the guide sleeve 32 and its lower end portion is driven into the ground which can be done manually, by use of the hydraulic ram units 42*a* and 42*b* in the manner described herein, or by the use of standard earth anchors, or the like. The clamping assembly 36 is then placed over the upper portion of the piling 50, and the hydraulic ram units 42*a* and 42*b*, in their extended positions shown in FIG. 2, are installed between the plates 26*a* and 40*a* and between the plates 26*b* and 40*b*, respectively, as described above.

The ram units 42*a* and 42*b* are then actuated simultaneously to cause a retracting motion of their corresponding pistons, and therefore the arms 44*a* and 44*b*, to force the clamping assembly 36 downwardly. As a result, the sleeve 38 grabs the piling 50 and drives it downwardly into the ground for a predetermined distance. The ram units 42*a* and 42*b* are then actuated again to extend the arms 44*a* and 44*b*, respectively, back to their fully extended position to move the clamping assembly 36 upwardly over the piling 50, and the sequence is repeated. During this sequential driving of the piling 50 into the ground, additional pilings may be added to the piling 50 as needed.

In this operation it is understood that the mounting plate 20 can take various angular positions relative to the side wall of the foundation F depending on the relative position of the piling 50. In this context, it is understood that a shim (not shown) can be inserted between the side wall of the foundation F and the mounting plate 20 as needed to stabilize and align the system during the above operation.

Figure 3:
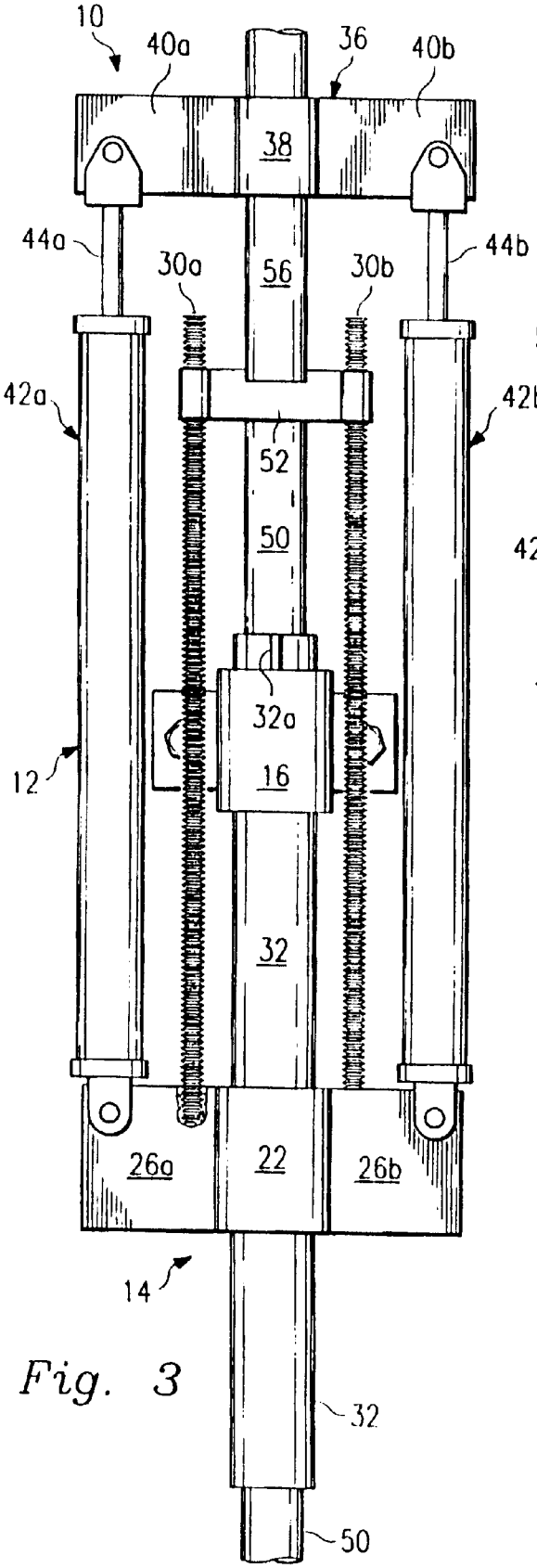
FIGS. 3 and 4 are elevational views of the system of the present invention respectively depicting two stages of the lifting operation.
Figure 4:
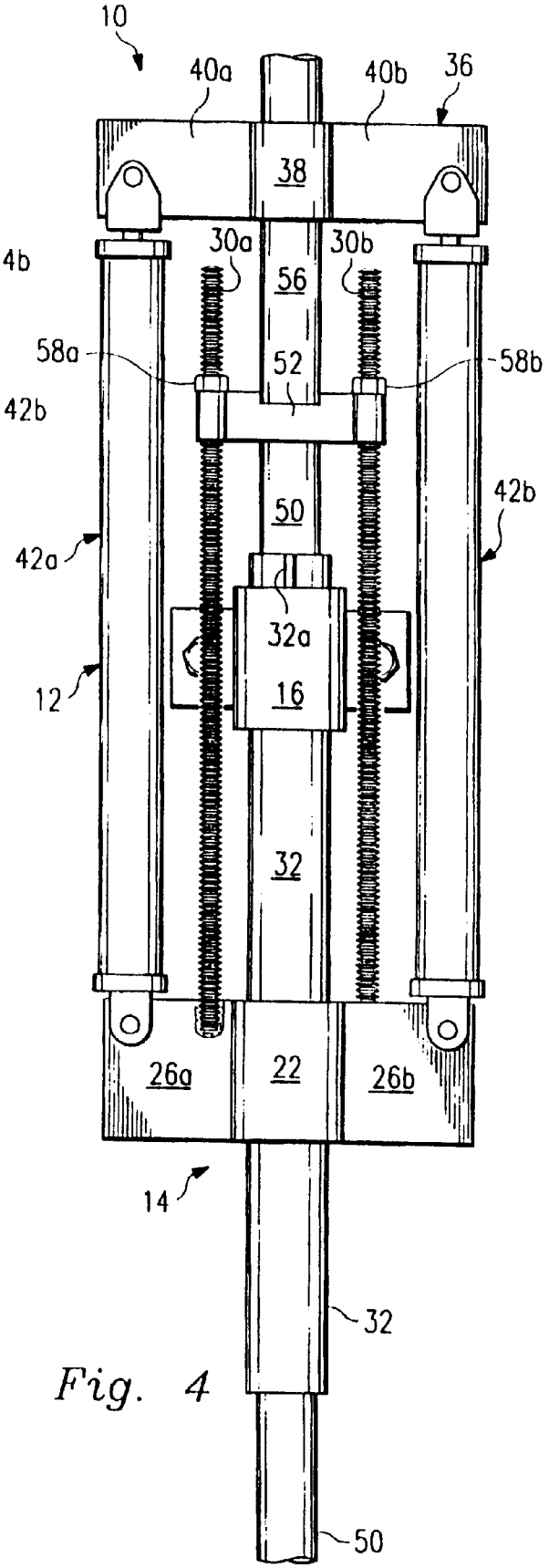

The above procedure is repeated until the lower end of the piling 50 encounters resistance in the ground, which is usually in the form of bedrock or the like, in which case the aforementioned driving movement is terminated and the lifting procedure depicted in FIGS. 3 and 4 is initiated.

To lift the foundation F, a drive plate 52, having two sleeves 52*a* and 52*b* at its ends, is positioned over the upper end of the piling 50 with the sleeves 52*a* and 52*b* extending over the rods 30*a* and 30*b*, respectively. A drive pipe segment 56 is then placed over the plate 52, with notches in the former extending over the upper edge of the latter.

As shown in FIG. 4, the clamping assembly 36 and the hydraulic ram units 42*a* and 42*b* are installed in the manner described in connection with FIG. 2 with the sleeve 38 extending over the pipe segment 56. The arms 44*a* and 44*b* of the ram units 42*a* and 42*b*, respectively are expanded to the extent needed for the sleeve 38 to grasp the upper end portion of the pipe segment 56.

The ram units 42*a* and 42*b* are then retracted to exert a vertical force against the pipe segment 46, and therefore the plate 52 and the piling 50. Since the piling 50 can no longer be driven downwardly due to the resistance provided by the bedrock, the foundation F will be lifted the desired amount causing the upper mounting assembly 12, the lower mounting assembly 14, and the guide sleeve 32 to move upwardly relative to the piling 50, the plate 52, and the pipe segment 56 to the position shown in FIG. 4. During this movement, the rods 30*a* and 30*b* move upwardly in, and relative to, their respective sleeves 52*a* and 52*b* of the drive plate 52 a distance corresponding to the distance of the lift of the foundation F.

A pair of nuts 58*a* and 58*b* are then advanced downwardly over the rods 30*a* and 30*b*, respectively until they engage the plate 52 to secure the foundation F in its raised position of FIG. 4. This sequence can be repeated until the desired amount of lifting is achieved after which the hydraulic ram units 42*a* and 42*b*, along with the clamping assembly 36 and the pipe segment 56, are removed, and the excavated area around the foundation F and the system 10 is filed with dirt.

As stated above, although only one system 10 is shown in the drawing it is understood that, in actual practice, several systems can be used at once at different locations along the foundation F depending on the extent of the amount of lifting that is done. In this context, after all of the pilings 50 associated with the respective systems 10 have been driven into the ground until they encounter resistance, the ram units 42*a* and 42*b* associated with the pilings are simultaneously actuated again in the manner described above to uniformly raise the foundation F, and therefore the house, a predetermined distance.

It is apparent from the foregoing that several advantages result from the system of the present invention. For example, the piling 50 is supported on load-bearing bedrock and the support sleeves 16 and 22 and the guide sleeve 32 enable a symmetrical, stabilized, coaxially-directed load to be applied to each piling through a moment arm defined by the plate 18 and the I-beam 24 that provides a significant mechanical advantage. Also, the piling 50 is easily attached relative to the raised foundation F with a minimum of time and effort. Further, the system of the present invention eliminates the need for high pressure ram devices, yet permits all of the pilings associated with the particular foundation to be raised at once. Still further, the system of the present invention can be quickly and easily attached to the foundation after the lift, by simply threading the nuts 58*a* and 58*b* over the two threaded rods 30*a* and 30*b*.

Figure 5:
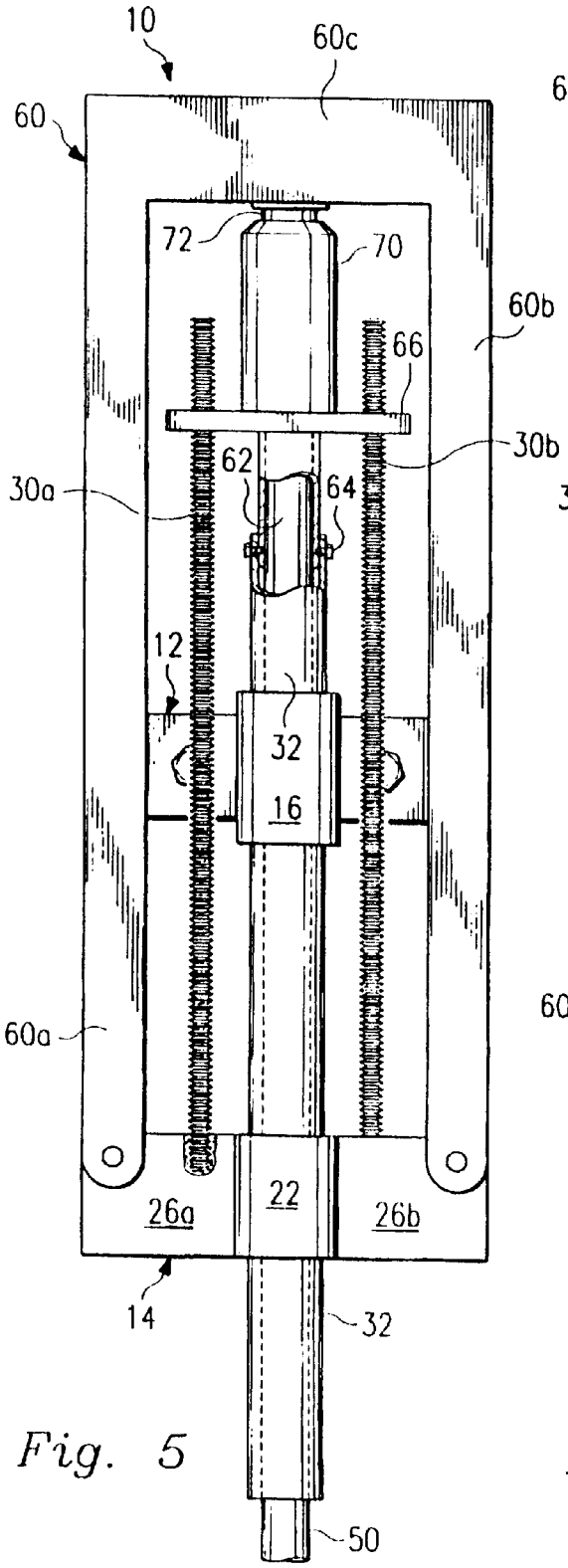
FIGS. 5 and 6 are views similar to FIGS. 3 and 4, respectively, but depicting an alternative embodiment for performing the lifting operation.
Figure 6:
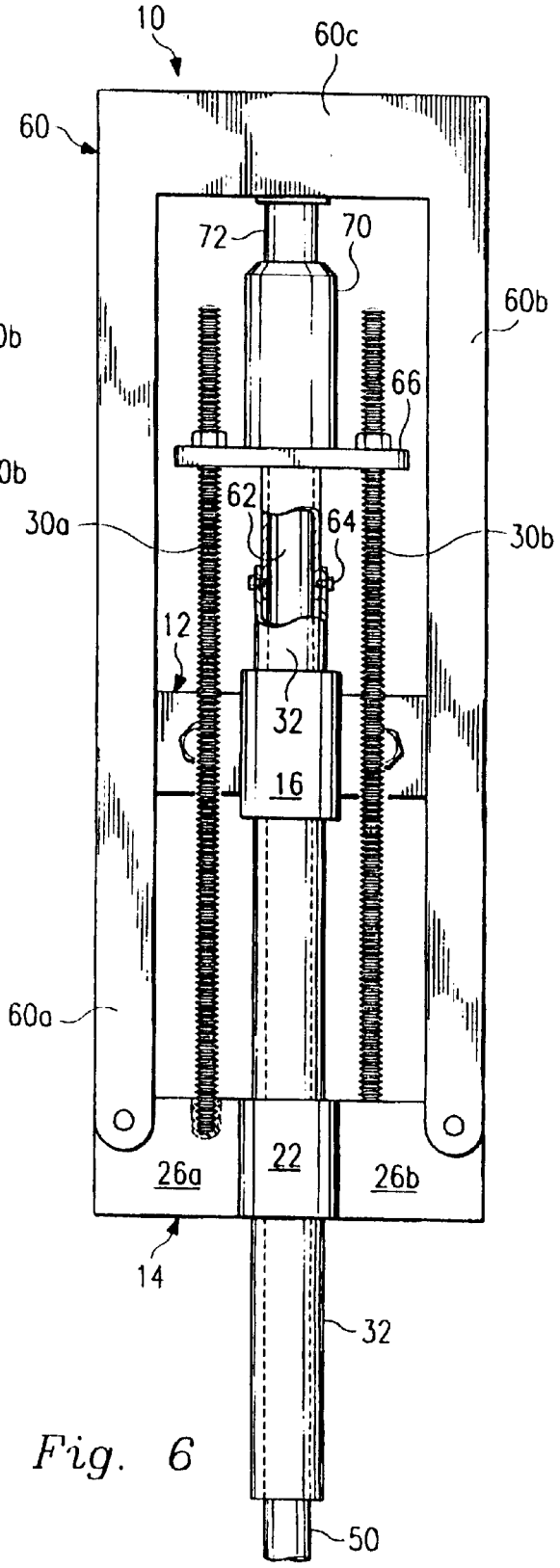

FIGS. 5 and 6 depict an alternative embodiment of the system of the present for use in the lifting operation after the piling 50 has been driven into the ground according to the technique described in connection with FIGS. 1 and 2. The alternative embodiment of FIGS. 5 and 6 contains some components that are identical to those used in the lifting operation of the previous embodiment shown in FIGS. 3 and 4, which components are given the same reference numerals.

According to the embodiment of FIGS. 5 and 6, a substantially U-shaped frame 60 is provided, which has two legs 60*a* and 60*b* the respective ends of which are connected to the plates 26*a* and 26*b* in the same manner as the ends of the ram units 42*a* and 42*b* of the previous embodiment. The frame 60 includes a cross-piece 60*c* that connects the other ends of the legs 60*a* and 60*b* and which extends above the corresponding ends of the threaded rods 30*a* and 30*b*.

The upper portion of the guide sleeve 32 projects outwardly fiom the upper end of the sleeve 16 and receives a mounting sleeve 62, the lower end portion of which extends in the upper end portion of the guide sleeve and is connected thereto by two or more radially extending bolts 64. The piling 50, which has been driven in the ground until resistance is encountered as discussed in connection with FIGS. 1 and 2, is cut so that its upper end portion extends in the mounting sleeve 62 and its upper end engages the lower surface of a horizontally extending mounting plate 66 connected to the upper end of the mounting sleeve in any known manner. Two openings are provided in the plate 66 for receiving the threaded rods 30*a* and 30*b* in a loose fit, for reasons to be explained.

A hydraulic cylinder 70 is mounted on the upper surface of the mounting plate 66 and receives a piston 72, a portion of which projects outwardly from the upper end of the cylinder and engages the lower surface of the cross-piece 60*c* of the frame 60. The cylinder 70 is adapted to be actuated to selectively expand and retract the piston 72 in a conventional manner to cause corresponding movement of the frame 60. The remaining components, including the upper mounting assembly 12 and the lower mounting assembly 14 are identical to those of the previous embodiment.

To lift the foundation F in accordance with the embodiment of FIGS. 5 and 6, the abovementioned components are mounted in the position shown in FIG. 5 with the piston 72 in its retracted position relative to the cylinder 70. The cylinder 70 is actuated to extend the piston 72 and thus exert an upwardly-directed, vertically-extending, force against the frame 60 which raises the upper mounting assembly and the lower mounting assembly 14 a corresponding distance. During this movement, the rods 30*a* and 30*b* move upwardly in, and relative to, their respective openings in the mounting plate 66 a distance also corresponding to the distance of the lift of the foundation F.

The nuts 58*a* and 58*b* are then advanced downwardly over the rods 30*a* and 30*b*, respectively, as in the previous embodiment until they engage the plate 66 to secure the foundation F in its raised position of FIG. 4. This sequence can be repeated until the desired amount of lifting is achieved after which the frame 60 and the cylinder 70 are removed, and the excavated area around the foundation F and the system 10 is filed with dirt.

The embodiment of FIGS. 5 and 6 enjoys all of the advantages of the embodiment of FIGS. 3 and 4 while permitting a single cylinder/piston assembly to be used. The embodiment of FIGS. 5 and 6 also permits several systems to be used at once at different locations along the foundation F depending on the extent of the amount of lifting desired.

It is understood that, although the above embodiments were described in connection with the foundation of a building, the system of the present invention can also be used in an identical manner to raise a concrete slab extending underneath the entire area of a building or a house. In the case of a concrete slab, the system 10 would be mounted on an outer wall of the slab. Therefore, for the purposes of this application, the term "foundation" refers to a conventional building foundation and a concrete slab. Also, when the term "piling" is used in the singular it is understood that it can refer to one long continuous piling or a plurality of piling sections which, when applicable, are connected together at their corresponding ends in any conventional manner.

It is understood that several modifications of the system of the present invention can be made within the scope of the invention. For example, the clamping assembly 36 used in the driving operation shown in the driving embodiment of FIGS. 1 and 2, and in the lifting embodiment of FIGS. 3 and 4, can be replaced with a block, or driving member, that engages the upper end of the piling 50 and, when forced downwardly by the ram units 42*a* and 42*b*, drives the assembly into the ground. Also, an external drive system using an auger blade, or the like, can be provided to initially drive the piling 50 into the ground until a predetermined resistance is encountered, after which the ram units 42*a* and 42*b* of the embodiment of FIGS. 3 and 4, or the frame 60 and cylinder 70 of the embodiment of FIGS. 5 and 6 would be installed and activated to raise the foundation or slab in the manner described above.

Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention therein.

What is claimed is:

1. A system for raising and supporting the foundation of a building, said system comprising:

first mounting means comprising a first sleeve and a first support member extending from the first sleeve for engaging the lower surface of the foundation;

a second mounting means comprising a second sleeve coaxially aligned with, and spaced from, the first sleeve, and a second support member extending from the second sleeve to the side wall of the foundation;

means for fastening the second support member, and therefore the second sleeve, to the side wall;

a piling extending through the sleeves;

at least one hydraulic unit connected to the first mounting means and adapted to engage the piling for applying a load to the piling to drive the piling into the ground until the piling encounters a predetermined resistance, after which the foundation is raised relative to the piling; and means for securing the foundation in the raised position.

2. The system of claim 1 wherein the first mounting means further comprises at least one plate extending from the first sleeve, the hydraulic unit being connected to the plate.

3. The system of claim 1 further comprising a guide sleeve extending between the piling and each of the sleeves.

4. The system of claim 1 wherein the hydraulic unit is normally in an expanded position and retracts to drive the piling.

5. The system of claim 1 wherein there are two hydraulic units disposed on opposite sides of the piling.

6. The system of claim 5 wherein the first mounting means further comprises two plates extending from the first sleeve for respectively receiving the hydraulic units.

7. The system of claim 1 further comprising a clamping member adapted to extend around the upper portion of the piling and connected to the hydraulic unit for reciprocal movement therewith.

8. The system of claim 7 wherein the clamping member is adapted to clamp the piling upon downward movement relative thereto and to disengage the piling upon upward movement relative thereto.

9. The system of claim 1 further comprising at least one rod extending upwardly from the first sleeve, and a plate adapted to be connected to the piling and having an opening for receiving the rod and permitting movement of the rod relative thereto.

10. The system of claim 9 wherein there are two rods extending to each side of the piling, and wherein the securing means comprises a pair of nuts in threaded engagement with the rods to secure the rods relative to the plate in the raised position of the foundation.

11. The system of claim 9 wherein the piling means comprises a plurality of pipe segments and wherein the plate extends between two adjacent segments.

12. A system for raising and supporting the foundation of a building, said system comprising:

first mounting means comprising a first sleeve and a first support member extending from the first sleeve for engaging the lower surface of the foundation;

a second mounting means comprising a second sleeve coaxially aligned with, and spaced from, the first sleeve, and a second support member extending from the second sleeve to the side wall of the foundation;

means for fastening the second support member, and therefore the second sleeve, to the side wall;

a piling extending through the sleeves;

a first hydraulic unit adapted to be connected to the first mounting means and adapted to engage the piling for initially applying a load to the piling to drive the piling into the ground until the piling encounters a predetermined resistance;

a second hydraulic unit adapted to be connected to the first mounting means and adapted to engage the piling for applying a load to the piling to raise the foundation relative to the piling; and means for securing the foundation in the raised position.

13. The system of claim 12 wherein the first mounting means further comprises at least one plate extending from the first sleeve, the hydraulic unit being connected to the plate.

14. The system of claim 12 further comprising a guide sleeve extending between the piling and each of the sleeves.

15. The system of claim 12 wherein the first hydraulic unit is normally in an expanded position and retracts to drive the piling and wherein the second hydraulic unit is nomially in a retracted position and expends to raise the foundation.

16. The system of claim 12 wherein the first hydraulic unit comprising two ram units disposed on opposite sides of the piling.

17. The system of claim 16 wherein the first mounting means further comprises two plates extending from the first sleeve for respectively receiving the ram units.

18. The system of claim 12 further comprising a clamping member adapted to extend around the upper portion of the piling and connected to the first hydraulic unit for reciprocal movement therewith.

19. The system of claim 18 wherein the clamping member is adapted to clamp the piling upon downward movement relative thereto and to disengage the piling upon upward movement relative thereto.

20. The system of claim 12 further comprising at least one rod extending upwardly from the first sleeve, and a plate adapted to be connected to the piling and having an opening for receiving the rod and permitting movement of the rod relative thereto.

21. The system of claim 20 wherein there are two rods extending to each side of the piling, and wherein the securing means comprises a pair of nuts in threaded engagement with the rods to secure the rods relative to the plate in the raised position of the foundation.

22. The system of claim 20 wherein the piling means comprises a plurality of pipe segments and wherein the plate extends between two adjacent segments.

23. A method for raising and supporting the foundation of a building, said method comprising the steps of:

engaging the lower surface of the foundation with a first mounting unit;

bolting a second mounting unit to a side wall of the foundation;

inserting a piling two coaxially aligned, vertically spaced sleeves respectively associated withe the first and second mounting units;

connecting a first hydraulic unit to the first mounting means and to the piling for initially applying a load to the piling to drive the piling into the ground until the piling encounters a predetermined resistance;

connecting a second hydraulic unit adapted to the first mounting means and adapted to engage the piling for applying a load to the piling to raise the foundation relative to the piling; and securing the foundation in the raised position.

24. The method of claim 23 further comprising the step of inserting a guide sleeve between the piling and each of the sleeves.

25. The method of claim 23 wherein the first hydraulic unit is normally in an expanded position and further comprising the step of retracting the first hydraulic unit to drive the piling.

26. The method of claim 25 wherein, during the step of retracting, the first hydraulic unit clamps the piling upon downward movement relative thereto and disengages the piling upon upward movement relative thereto.

27. The method of claim 23 wherein the second hydraulic unit is normally in a retracted position and further comprising the step of expanding the second hydraulic unit to raise the foundation.

28. The method of claim 23 wherein the step of securing comprising the step of connecting two threaded rods to the first mounting means, connecting a plate to the piling in a manner to permit movement of the rods relative to the plate during the raising of the foundation, and threading two nuts over the respective rods.

29. The system of claim 1 wherein the first support member is a first plate fastened at one end to the sleeve, and wherein the fastening means comprises a second plate fastened to the other end of the first plate and having openings extending therethrough for receiving fastening members for fastening the second plate to the side wall.

30. The system of claim 29 wherein the fastening members are bolts.

31. The system of claim 12 wherein the first support member is a first plate fastened at one end to the sleeve, and wherein the fastening means comprises a second plate fastened to the other end of the first plate and having openings extending therethrough for receiving fastening members for fastening the second plate to the side wall.

32. The system of claim 31 wherein the fastening members are bolts.

* * * * *